US012637820B2

(12) United States Patent
Scarberry et al.

(10) Patent No.: US 12,637,820 B2
(45) Date of Patent: May 26, 2026

(54) FORCED AIR SNOW REMOVAL SYSTEM

(71) Applicants: Eugene Nelson Scarberry, Trafford, PA (US); Praveen Kumar Pandian Shanmuganathan, Seven Fields, PA (US)

(72) Inventors: Eugene Nelson Scarberry, Trafford, PA (US); Praveen Kumar Pandian Shanmuganathan, Seven Fields, PA (US)

( * ) Notice: Subject to any disclaimer, the term of this patent is extended or adjusted under 35 U.S.C. 154(b) by 33 days.

(21) Appl. No.: 18/423,676

(22) Filed: Jan. 26, 2024

(65) Prior Publication Data

US 2024/0254708 A1 Aug. 1, 2024

Related U.S. Application Data

(60) Provisional application No. 63/441,978, filed on Jan. 30, 2023.

(51) Int. Cl.
*E01H 5/10* (2006.01)

(52) U.S. Cl.
CPC ..... *E01H 5/106* (2013.01)

(58) Field of Classification Search
CPC ..... E01H 5/106
See application file for complete search history.

(56) References Cited

U.S. PATENT DOCUMENTS 2,894,704 A * 7/1959 Bone ..... E01B 19/00 246/428
3,041,748 A * 7/1962 Wetzel ..... E01H 5/106 239/592
3,697,746 A 10/1972 Patterson
3,972,497 A 8/1976 Ringer
4,081,161 A 3/1978 Upright
4,092,789 A * 6/1978 Arfons ..... E01H 1/08 15/340.1
4,226,034 A * 10/1980 Benjamin ..... E01H 5/106 15/340.1
4,379,217 A * 4/1983 Youmans ..... B23K 26/354 244/17.11
4,633,603 A * 1/1987 David ..... E01H 5/106 37/197
4,674,718 A 6/1987 Bjorklund
6,065,721 A 5/2000 Sumpton
(Continued)

FOREIGN PATENT DOCUMENTS

CA 2767953 A1 * 1/2011 ..... B64F 5/0063
CN 104278654 B * 4/2016 ..... E01H 5/04
(Continued)

*Primary Examiner* — Gary S Hartmann
(74) *Attorney, Agent, or Firm* — BARTONY & ASSOCIATES, LLC

(57) ABSTRACT

A system for snow removal from a surface includes one or more blower systems. Each blower system includes a blower to pressurize air, a conduit in fluid connection with the blower, and a control system to control parameters of operation of the blower system. The conduit includes one or more passages therein from which pressurized air is blown to remove snow from the surface adjacent the position of the one or more blower systems. The control system is configured to pivot the conduit about a sweep axis over a determined sweep angle of at least 100 degrees.

25 Claims, 2 Drawing Sheets

(56) References Cited

U.S. PATENT DOCUMENTS

| | | | | |
|---|---|---|---|---|
| 6,842,997 | B1 | 1/2005 | Fratello | |
| 8,006,559 | B2 | 8/2011 | Mian | |
| 8,043,147 | B2 | 10/2011 | Nakai | |
| 8,857,451 | B2 * | 10/2014 | Opdyke | B60S 3/002 134/123 |
| 2007/0246579 | A1 | 10/2007 | Blateri | |
| 2009/0166444 | A1 * | 7/2009 | Peterson | F04D 29/601 416/247 R |
| 2012/0017949 | A1 * | 1/2012 | Fehringer | E04D 13/106 134/34 |
| 2012/0255585 | A1 | 10/2012 | Kowalczyk | |

FOREIGN PATENT DOCUMENTS

| | | | | | |
|---|---|---|---|---|---|
| CN | 107799865 | A | | 3/2018 | |
| CN | 112281737 | A | | 1/2021 | |
| DE | 3734839 | A1 | | 5/1988 | |
| EP | 3434824 | A1 | | 1/2019 | |
| JP | S62106247 | A | * | 5/1987 | |
| JP | H03228979 | A | * | 9/1991 | |
| JP | 2018178422 | A | * | 11/2018 | |
| KR | 20050005946 | A | * | 1/2005 | |
| SU | 977551 | A1 | * | 11/1892 | |
| WO | WO-0212635 | A1 | * | 2/2002 | B60B 39/00 |

* cited by examiner

FIG. 2A
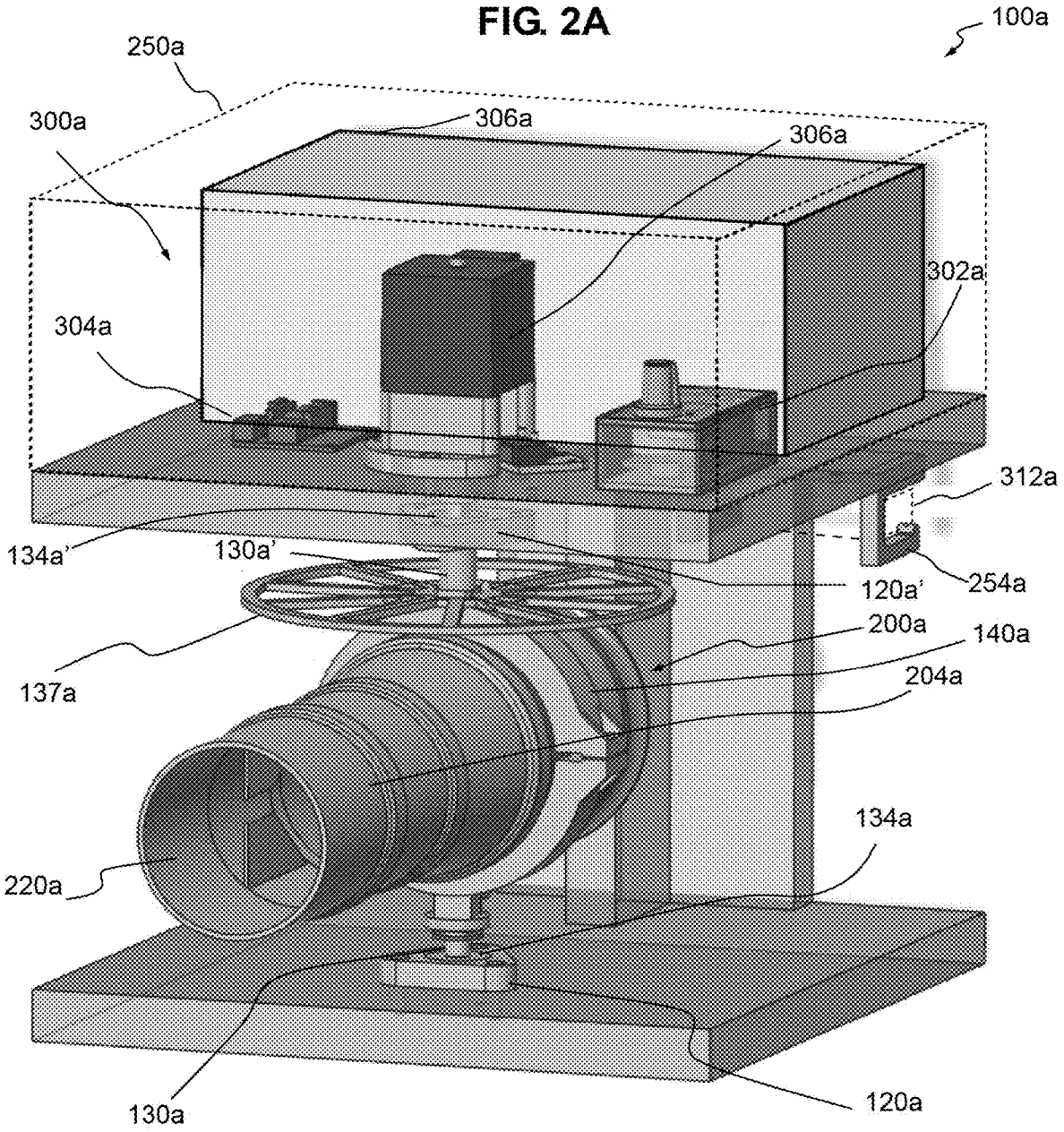
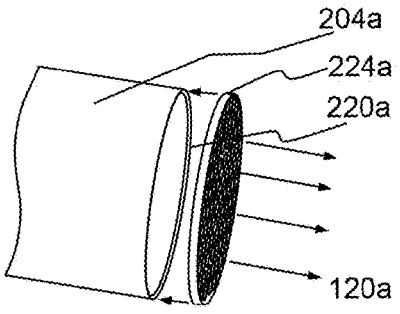
FIG. 2B
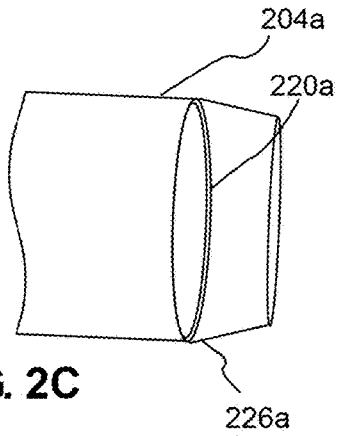
FIG. 2C

FORCED AIR SNOW REMOVAL SYSTEM

CROSS-REFERENCE TO RELATED APPLICATIONS

This application claims benefit of U.S. Provisional Patent Application Ser. No. 63/441,978, filed Jan. 30, 2023, the disclosure of which is incorporated herein by reference.

BACKGROUND

The following information is provided to assist the reader in understanding technologies disclosed below and the environment in which such technologies may typically be used. The terms used herein are not intended to be limited to any particular narrow interpretation unless clearly stated otherwise in this document. References set forth herein may facilitate understanding of the technologies or the background thereof. The disclosure of all references cited herein are incorporated by reference.

Clearing snow from a surface typically involves at least one of shoveling, using a powered snow blower, plowing, manually operating a blower, or heating the surface. There are many problems and disadvantages associated with each of those methods including, for example, significant expense (for example, costs associated with purchasing equipment, costs associated running equipment, costs associated with independent contractors, etc.), requirements of physical dexterity and/or strength which may be lacking in an aging population and in individuals with impairment, and storage space for equipment.

A number of automated systems are commercially available which operate in a manner similar to an automatic vacuum cleaner. In such systems, a surface to be cleared is typically marked so that an automated, powered snow blower or an automated plow system can clear a specific area.

It remains desirable to develop improved devices, systems, and method for snow removal.

SUMMARY

In one aspect, a system for snow removal from a surface includes one or more blower systems. Each blower system includes a blower to pressurize air, a conduit in fluid connection with the blower, and a control system to control parameters of operation of the blower system. The conduit includes one or more passages therein from which pressurized air is blown to remove snow from the surface. The control system is configured to pivot the conduit about a sweep axis over a determined sweep angle of at least 100 degrees. In a number of embodiments, the determined sweep angle is at least 140, 180, or 200 degrees. In a number of embodiments, the system includes a plurality of the blower systems positioned at spaced locations.

The one or more passages may, for example, be positioned at an axial end of the conduit of each of the one or more blower systems. In a number of embodiments, each of the one or more blower systems includes a conduit comprising a single passage at an axial end thereof through which air is blown.

In a number of embodiments, the sweep axis is generally perpendicular to an axis of the conduit. Each of the one or more blower systems may further include a base and a support operably connectible with the base and defining the sweep axis. The support may, for example, extend upward from the base.

The control system may, for example, include a processor system, a memory system in communicative connection with the processor system, and one or more algorithms stored in the memory system and executable by the processor system to control parameters of operation of the one or more blower systems.

A method of removing snow from a surface includes placing a system for snow removal on, or in the vicinity of, a surface from which snow is to be removed. The system include one or more blower systems. Each blower system includes a blower to pressurize air and a conduit in fluid connection with the blower. The conduit includes one or more passages therein from which pressurized air is blown to remove snow from the surface. The blower system further include a control system to control parameters of operation of the blower system.

The control system may be configured to pivot the conduit about a sweep axis over a determined sweep angle of at least 100 degrees. In a number of embodiments, the determined sweep angle is at least 140 degrees, at least 180 degrees, or at least 200 degrees. In a number of embodiments, the sweep axis is generally perpendicular to an axis of the conduit. In a number of embodiments, the blower system further includes a base and a support operably connectible with the base and defining the sweep axis.

The one or more passages of the conduit of each of the one or more blower systems may be positioned at an axial end of the conduit. Each of the one or more blower systems may, for example, include a conduit including a single passage at an axial end thereof through which air is blown.

The control system may, for example, include a processor system, a memory system in communicative connection with the processor system, and one or more algorithms stored in the memory system and executable by the processor system to control parameters of operation of the one or more blower systems. Such positions are readily determined using blower system parameters, site characteristics, and known engineering principles.

In a number of embodiments, the method includes placing a plurality of the blower systems at spaced locations. The surface may, for example, include at least one of a driveway, a sidewalk, or a roof.

The present devices, systems, and methods along with the attributes and attendant advantages thereof, will best be appreciated and understood in view of the following detailed description taken in conjunction with the accompanying drawings.

BRIEF DESCRIPTION OF THE DRAWINGS

FIG. 2A illustrates a perspective view of a representative embodiment of a blower device for a snow removal system hereof.

FIG. 2B illustrates a side perspective view of a portion of the conduit or duct of the blower device of FIG. 2A including a straightener in connection with a distal end of the conduit or duct which include a plurality of like, small tubes in a parallel orientation to channel the pressurized air in a desired direction.

FIG. 2C illustrates a side perspective view of a portion of the conduit or duct of the blower device of FIG. 2A including a nozzle in connection with a distal end of the conduit or duct which focuses and directs airflow.

DETAILED DESCRIPTION

Figure 1:
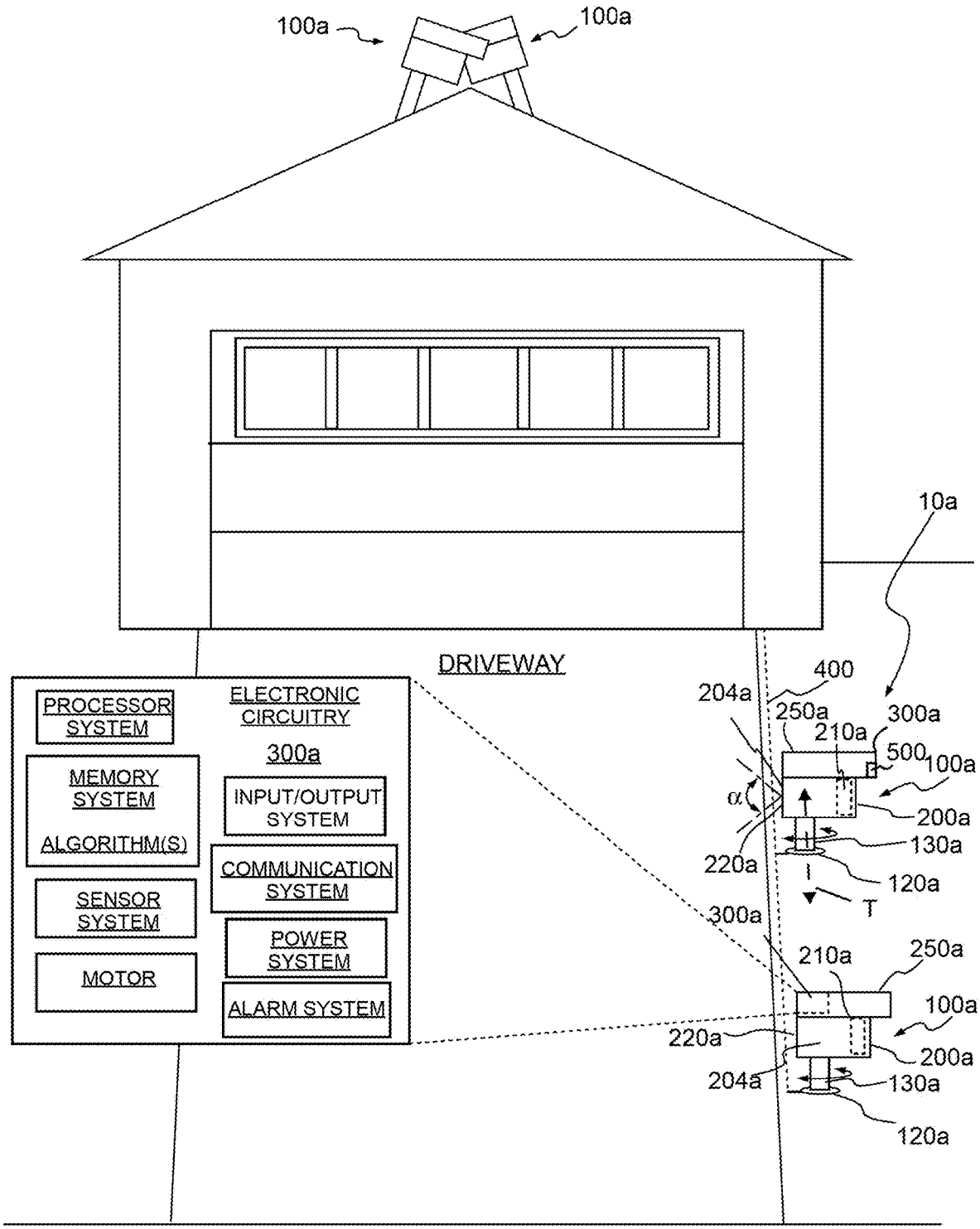
FIG. 1 illustrates schematically a representative embodiment of a snow removal system hereof including one or more towers or blower systems from which pressurized air is blown across a surface.

It will be readily understood that the components of the embodiments, as generally described and illustrated in the figures herein, may be arranged and designed in a wide variety of different configurations in addition to the described representative embodiments. Thus, the following more detailed description of the representative embodiments, as illustrated in the figures, is not intended to limit the scope of the embodiments, as claimed, but is merely illustrative of representative embodiments.

Reference throughout this specification to "one embodiment" or "an embodiment" (or the like) means that a particular feature, structure, or characteristic described in connection with the embodiment is included in at least one embodiment. Thus, the appearance of the phrases "in one embodiment" or "in an embodiment" or the like in various places throughout this specification are not necessarily all referring to the same embodiment.

Furthermore, described features, structures, or characteristics may be combined in any suitable manner in one or more embodiments. In the following description, numerous specific details are provided to give a thorough understanding of embodiments. One skilled in the relevant art will recognize, however, that the various embodiments can be practiced without one or more of the specific details, or with other methods, components, materials, et cetera. In other instances, well known structures, materials, or operations are not shown or described in detail to avoid obfuscation.

As used herein and in the appended claims, the singular forms "a," "an", and "the" include plural references unless the context clearly dictates otherwise. Thus, for example, reference to "a blower" includes a plurality of such blowers and equivalents thereof known to those skilled in the art, and so forth, and reference to "the blower" is a reference to one or more such blowers and equivalents thereof known to those skilled in the art, and so forth. Recitation of ranges of values herein are merely intended to serve as a shorthand method of referring individually to each separate value falling within the range. Unless otherwise indicated herein, each separate value, as well as intermediate ranges, are incorporated into the specification as if individually recited herein. All methods described herein can be performed in any suitable order unless otherwise indicated herein or otherwise clearly contraindicated by the text.

The terms "electronic circuitry", "circuitry" or "circuit," as used herein include, but are not limited to, hardware, firmware, software, or combinations of each to perform a function(s) or an action(s). For example, based on a desired feature or need, a circuit may include a software controlled microprocessor, discrete logic such as an application specific integrated circuit (ASIC), or other programmed logic device. A circuit may also be fully embodied as software. As used herein, "circuit" is considered synonymous with "logic." The term "logic", as used herein includes, but is not limited to, hardware, firmware, software, or combinations of each to perform a function(s) or an action(s), or to cause a function or action from another component. For example, based on a desired application or need, logic may include a software controlled microprocessor, discrete logic such as an application specific integrated circuit (ASIC), or other programmed logic device. Logic may also be fully embodied as software.

The term "processor," as used herein includes, but is not limited to, one or more of virtually any number of processor systems or stand-alone processors, such as microprocessors, microcontrollers, central processing units (CPUs), and digital signal processors (DSPs), in any combination. The processor may be associated with various other circuits that support operation of the processor, such as random access memory (RAM), read-only memory (ROM), programmable read-only memory (PROM), erasable programmable read only memory (EPROM), clocks, decoders, memory controllers, or interrupt controllers, etc. These support circuits may be internal or external to the processor or its associated electronic packaging. The support circuits are in operative communication with the processor. The support circuits are not necessarily shown separate from the processor in block diagrams or other drawings.

The term "controller," as used herein includes, but is not limited to, any circuit or device that coordinates and controls the operation of one or more input and/or output devices. A controller may, for example, include a device having one or more processors, microprocessors, or central processing units capable of being programmed to perform functions.

The term "software," as used herein includes, but is not limited to, one or more computer readable or executable instructions that cause a computer or other electronic device to perform functions, actions, or behave in a desired manner. The instructions may be embodied in various forms such as routines, algorithms, modules, or programs including separate applications or code from dynamically linked libraries. Software may also be implemented in various forms such as a stand-alone program, a function call, a servlet, an applet, instructions stored in a memory, part of an operating system or other type of executable instructions. It will be appreciated by one of ordinary skill in the art that the form of software is dependent on, for example, requirements of a desired application, the environment it runs on, or the desires of a designer/programmer or the like.

Systems, devices, and methods hereof use high-flow, high-pressure air blown across a surface (for example, a driveway, sidewalk, a roof, etc.) to reduce or minimize snow remaining on the surface as a result of a snow storm. FIG. 1 illustrates a representative embodiment of a snow-removal system 10*a* hereof which includes one or more (two in the illustrated embodiment) relatively high-flow, high-pressure air blower systems 100*a* positioned in operative connection with a surface of a driveway and with the opposing surfaces of a roof to be cleared of snow. In the illustrated embodiment, two spaced air blower systems or towers 100*a* are positioned on one side of a driveway. Further, two spaced air blower systems or towers 100*a* are illustrated on each side of the roof ridge of the illustrated building. Blower system or towers 100*a* on the roof of the building are angled to rotate approximately parallel to the pitch of the roof. Each air blower system or tower 100*a*, in the illustrated embodiment includes, a base 120*a* (not shown for blower systems or towers 100*a* on the roof) and a support or shaft 130*a* operatively connectible to base 120*a*, for example, via a seating or passage in base 120*a*.

A blower 200*a* may, for example, include a generally cylindrical housing, conduit or duct 204*a* having a blower fan 210*a* therein. An opening 220*a* in housing 204*a* is oriented toward the surface to be cleared. Blower 200*a* may, for example, be mounted on support 130*a* to be relatively close to (or in the vicinity of) the surface (for example, ground, roof, etc.) or on the surface so that air is blown over/on the surface in a manner to prevent snow from settling thereon and/or to remove snow therefrom. In a number of embodiments, blower 200*a* is rotatable or pivotable about the axis of support or shaft 130*a* over a range or sweep angle represented by the angle α in FIG. 1 such that the range or area covered by each blower system (in embodiment in which multiple blower systems or towers 100*a* are placed in spaced positions to cover a surface) may, for example, overlap to optimize snow removal. The sweep angel α may be adjustable. In a number of embodiments, the sweep angle α is at least 100, at least 140, at least 180, or at least 200 degrees. The positioning of air blower systems 100*a* relative to the surface, sweep angle α, the rate of sweep through sweep angle α or dwell time, the angle of the axis of conduit 204*a* relative to the surface, the air volume, the air flow rate, etc. may be adjustable to improve or optimize results for specific areas of surface/sites from which snow is to be removed. For example, as clear to one skilled in the art, the parameters to clear a three-foot wide sidewalk may not be the same as those needed for a 20-foot wide driveway. Suitable parameters are readily determined by a user for any surface area and associated conditions.

In a number of studied embodiments hereof, blower fan 210*a* was a ducted fan such as the ducted fans used in aeronautics for remote controlled (RC) aircraft (see FIG. 2A). In general, ducted fans are thrust-generating fans or propellers which are mounted within a cylindrical duct or shroud. In the studies of Table 1 below, two different sized fans, 90 mm and 70 mm, were tested. It is desirable to channel, direct, or laminarize the airflow from blower 200*a*. In the case of the 90 mm blower, a straightener 224*a* (see FIG. 2B) including a plurality of like, small tubes in a parallel orientation may be placed over opening 220*a* to channel the pressurized air in a desired direction. In the case of the 70 mm blower, a nozzle 226*a* (illustrated schematically in FIG. 2C) may be used to focus and direct airflow. In the case of the ducted fans studied, the motor for the fan is positioned in the center of the fan. The center portion of the fan, thus produces no energy. Nozzle 226*a* included an opening that was approximately the same area as energy-producing area of the fan blade. Nozzle 226*a* is configured or is operatable to funnel or focus the airflow and increases velocity.

In a number of representative studies, distance from the bottom of the base 120*a* (ground/surface level) to the bottom of the blower was approximately 8.26 cm (3.25 inches) for the 70 mm model and 8.89 cm (3.5 inches) for the 90 mm model. In a number of embodiments, one or more of bases 120*a* may include a track system (represented by arrow T in FIG. 1) to allow powered travel (for example, via a motor) of air blower systems 100*a* along the surface/ground to which base 120*a* is operatively connected to provided increased coverage for such air blower systems 100*a*.

TABLE 1

| Fan | 90 mm | 90 mmW Straightener | 70 mm | 70 mmW New Nozzle |
|---|---|---|---|---|
| Speed | 60% | 60% | 95% | 95% |
| Grams of Thrust | 1190 | 1137 | 603 | 843 |
| Air Flow mph @ 10' | 16.5 | 14.5 | 10.7 | 14.3 |
| Air Flow mph @ 15' | 10.3 | 8.7 | 7.2 | 9.2 |
| Decibels @ 10' | 80 | | | |
| Decibels @ 15' | 75 | 75 | 75 | 72 |

In a number of embodiments, electronic circuitry 300*a* (a representative embodiment which is illustrated schematically in FIG. 1), which may be housed within a housing 250*a*, is provided in operative connection with blower 200*a* to, for example, control activation of blower systems 100*a* and control the parameters of operation thereof. As illustrated in FIG. 2, in a number of embodiments, a mount 254 was attached to housing 250*a* to connect an electronic speed controller 312*a* (illustrated schematically in broken lines in FIG. 2). Alternatively, electronic speed controller 312*a* may be positioned within housing 250*a*. Electronic circuitry can, for example, include a processor system and a memory system in operative/communicative connection with the processor system. One or more software-based algorithms may be stored in the memory system and be executable by the processor system to control the operation of blower system 100*a*. An input/output system may be provided for data communication. A communication system may, for example, be provided for wired or wireless communication (for example, via a smartphone or other personal communication devices such as a tablet computer or computer).

In the embodiment illustrated in FIG. 2A, electronic circuitry 300*a* included a microchip controller 302*a* such as an ESP8266 Wi-Fi microchip with built-in TCP/IP networking software and a microcontroller, available from Espressif Systems of Shanghai, China. In the embodiment illustrated in FIG. 2A, the drive system for controlling pivoting or rotation of blower 200*a* over sweep angle α includes a stepper drive 304*a* in communicative connection with a stepper motor 306*a*. A power supply 308*a* is in electrical connection with the powered components of blower system 100*a* including, controller 302*a*, steeper driver 304*a*, stepper motor 306*a*, and blower fan 210*a* (see FIG. 1—not shown in FIG. 2A).

In the embodiment of FIG. 2A, drive motor 306*a* is operatively connected to a support or shaft 130*a*' to impart rotation to shaft 130*a*'. Shaft 130*a*' passes through a bearing 134*a*' of a mount or base 120*a*', which is connected to the lower surface of housing 250*a*. Shaft 130*a*' is in connection with a top section of a clamp or mount 140*a* to which blower 200*a* is mounted. In the illustrated embodiment, a wire rack 137*a* is connected to shaft 130*a*' to control one or more wires (not shown) extending from electric circuitry 300*a* to blower 200*a*. Wire rack 137*a* is configured to prevent the one or more wires from becoming entangled (for example, entangled around shaft 130*a*' with motion of shaft 130*a*' and attached blower 200*a*). In a number of embodiments, wire rack 137*a* can be eliminated, and the one or more wires may be coiled within housing 250*a*. Other components (for example, of electronic circuitry 300*a*) positioned within housing 250*a* may be mounted toward the top of housing 250*a* in such an embodiment to provide room for coiling of the one or more wires on the bottom of housing 250*a*. Clamp 140*a* is also connected to shaft 130*a* at a bottom section thereof. Shaft 130*a* is in operative connection with a bearing 134*a* of mount or base 120*a*.

A power system of system (including, for example, power supplies 308*a* of one or more blower systems 100*a*) may, for example, be connected to line power illustrated schematically in FIG. 1 as an underground electrical wire 400 (which may be positioned within conduit) in electrical communication with each of bases 120*a*. Electrical power can, for example, be provided from the electrical system of a home. As described above, the power system provides power to electronic circuitry 300*a* generally and powers motor 306*a* used to rotate blower 200*a* through sweep angle α over the dwell time of the sweep. Blower systems 100*a* hereof may be activated manually or automatically. For example, one or more sensors of a sensor system including, for example, moisture and temperature sensors, may be used to sense the beginning and/or ending of snowfall. Alternatively, an adjustable timer may be provided. An alarm system may be provided to provide alarms which may be audible and/or sent via data to user in case of a measured malfunction. In a number of embodiments, one of towers or blower systems 100*a* is a master, including master controls for the system, and the others of systems 100*a* are slaves. During operation the airflow may, for example, be controlled, while blower 200*a* is swept back and for the over sweep angle α at a determined rate, to have a volumetric flow rate and pressure which are sufficient to deflect and/or clear the snow from a surface to reduce or minimize snow left on the surface (for surfaces of a variety of widths and composition—for example, concrete, asphalt, gravel, loose stone, natural ground etc.). Uneven surfaces and/or surfaces including loose elements (for example, without a binder) such as gravel, loose stone, natural ground etc. are readily cleared of snow using the systems hereof but are difficult to clear using machinery such as plows or snowblowers.

One or more covers may be provided to cover electronics and/or blower 200*a* and may include noise suppression devices (as known in the noise suppression arts) to limit the noise emanating from blower system 100*a*. Noise suppression devices may also be incorporated in base 120*a*. In a number of embodiments, system 100*a* is designed to specifications such that it is operable to move snow at least 20 ft so that a driveway having a length of 60 ft and a width of 15 ft may be cleared with two towers or blower systems 100*a*. In a number of embodiments, blower systems 100*a* of system 10*a* are operated while maintaining the resultant noise level within the range of 70-90 dB to reduce the likelihood of creating a noise nuisance. In a number of embodiments, it is desirable that both towers or systems 100*a* operate with a total of 15 amps of available power. As clear to one skilled in the art, system parameters may be modified to clear surfaces of different dimensions and/or shapes. In a number of embodiments, for example, each tower or system 100*a* uses less than 7.5 amps of alternating current power. Thus, a typical outside 15 amp circuit as described above can be used in many homes for a two-tower system. Longer runs may, for example, require 20 amp or 220 volt systems.

All or a portion of systems 100*a* may, for example, be removable from bases 120*a* for storage. Alternatively, bases 120*a* may also be removable. A theft deterrent system can be provided for use when system(s) 100*a* are deployed for operation. For example, a spiral screw may be inserted into ground in the fall for lower base part of tower. A permanent version of system 100*a* may, for example, be embedded in the ground with a plastic (or other environmentally sealing) case. The top of such case may be removable deployment of system 100*a* for winter use.

In a number of embodiments, a system 500 (see FIG. 1) for injecting a liquid deicer agent can be included in operative and fluid connection with system 100*a*. Such liquid deicing agents are well-known for application to road surfaces. System 500 can, for example, include a pump or other mechanism to inject flow of a liquid deicer agent from a source of liquid deicer agent into the air flow of system 100*a* under control of the electronic circuitry hereof. Electronic circuitry 300*a* may, for example, control timing and amount of the application of liquid deicer agent. For example, a determined amount of liquid deicer agent may be applied after an amount of time of operating of system 100*a* to remove snow. Chemical compounds included in solution with water in deicing agents (to prevent and/or remove snow and ice) often include, for example, sodium chloride (salt), magnesium chloride, calcium chloride, calcium magnesium acetate and potassium acetate.

The foregoing description and accompanying drawings set forth a number of representative embodiments at the present time. Various modifications, additions and alternative designs will, of course, become apparent to those skilled in the art in light of the foregoing teachings without departing from the scope hereof, which is indicated by the following claims rather than by the foregoing description. All changes and variations that fall within the meaning and range of equivalency of the claims are to be embraced within their scope.

What is claimed is:

1. A system for snow removal from a surface, comprising: one or more blower systems, each blower system comprising a blower comprising a blower fan to pressurize air, a conduit in fluid connection with the blower, the conduit comprising one or more passages positioned at an axial end thereof distal from the blower from which pressurized air is blown to remove snow from the surface, which is adjacent a position of each of the one or more blower systems, each of the one or more blower systems further comprising a power system configured to be connected to line power and drawings 20 amps or less, and a base configured to be fixed at the position to either ground or a structure fixed to the ground, a support operably connected to the base and extending from the base to connect to the blower, and a control system to control parameters of operation of the blower system, each of the one or more blower system generating noise at a level of 90 db or less during operation measured at 10 feet from the blower, wherein the control system is configured to at least one of activate the blower automatically and to activate the blower upon receiving a manually initiated activation signal, the control system further being configured to automatically pivot the conduit reciprocally about a sweep axis over a determined sweep angle of at least 100 degrees while maintaining an axis of the conduit approximately aligned with the surface upon activation of the blower until deactivation thereof via the control system.

2. The system of claim 1 wherein each of the one or more blower systems comprise a conduit comprising a single passage at an axial end thereof through which air is blown.

3. The system of claim 1 wherein the sweep axis is generally perpendicular to an axis of the conduit.

4. The system of claim 1 wherein the support defines the sweep axis.

5. The system of claim 4 wherein the control system comprises a processor system, a memory system in communicative connection with the processor system, and one or more algorithms stored in the memory system and executable by the processor system to control parameters of operation of the one or more blower systems.

6. The system of claim 4 comprising a plurality of the blower systems positioned at spaced locations.

7. The system of claim 1 wherein the determined sweep angle is at least 140 degrees.

8. The system of claim 7 wherein the determined sweep angle is at least 180 degrees.

9. The system of claim 1 wherein the control system is configured to activate the blower at or before a beginning of a snow fall event and to continue activity of the blower during the snow fall event.

10. A method of removing snow from a surface, comprising:

placing a system for snow removal on or adjacent the surface from which snow is to be removed, the system comprising one or more blower systems, each blower system comprising a blower comprising a blower fan to pressurize air, a conduit in fluid connection with the blower, the conduit comprising one or more passages at an axial end thereof distal from the blower from which pressurized air is blown to remove snow from the surface adjacent a position of the one or more blower systems, each of the one or more blower systems further comprising a power system configured to be connected to line power and drawings 20 amps or less, and a base which is fixed at the position, which is on or adjacent of the surface, a support operably connected to the base and extending from the base to connect to the blower, each of the one or more blower system generating noise at a level of 90 db or less during operation, and a control system to control parameters of operation of the blower system, wherein the control system is configured to at least one of activate the blower automatically and to activate the blower upon receiving a manually initiated activation signal, and automatically pivot the conduit reciprocally about a sweep axis over a determined sweep angle of at least 100 degrees while maintaining an axis of the conduit approximately aligned with the surface via the control system upon activation of the blower until deactivation by the control system.

11. The method of claim 10 wherein each of the one or more blower systems comprise a conduit comprising a single passage at an axial end thereof through which air is blown.

12. The method of claim 10 wherein the sweep axis is generally perpendicular to an axis of the conduit.

13. The method of claim 10 wherein the support defines the sweep axis.

14. The method of claim 13 wherein the control system comprises a processor system, a memory system in communicative connection with the processor system, and one or more algorithms stored in the memory system and executable by the processor system to control parameters of operation of the one or more blower systems.

15. The method of claim 13 comprising placing a plurality of the blower systems at spaced locations on or in the vicinity of the surface.

16. The method of claim 10 wherein the determined sweep angle is at least 140 degrees.

17. The method of claim 16 wherein the determined sweep angle is at least 180 degrees.

18. The method of claim 10 wherein the surface comprises at least one of a driveway, a sidewalk, or a roof.

19. The method of claim 10 further comprising activating the blower at or before a beginning of a snow fall event and continuing activity of the blower during the snow fall event.

20. A system for snow removal from a surface, comprising:

one or more blower systems, each blower system comprising a blower comprising a blower fan to pressurize air, a conduit in fluid connection with the blower, the conduit comprising one or more passages positioned at an axial end of the conduit from which pressurized air is blown to remove snow from the surface, which is adjacent a position of each of the one or more blower systems, each of the one or more blower systems further comprising a power system configured to be connected to line power and drawings 20 amps or less, and a base configured to be fixed at the position to either ground or a structure fixed to the ground, a support operably connected to the base and extending from the base to connect to the blower, and a control system to control parameters of operation of the blower system, each of the one or more blower systems generating noise at a level of 90 db or less during operation measured at 10 feet from the blower, wherein the control system is configured to at least one of activate the blower automatically and to activate the blower upon receiving a manually initiated activation signal, the control system further being configured to automatically pivot the conduit reciprocally about a sweep axis over a determined sweep angle of at least 100 degrees upon activation of the blower until deactivation thereof via the control system, wherein the sweep axis is generally perpendicular to an axis of the conduit.

21. The system of claim 20 wherein the control system comprises a processor system, a memory system in communicative connection with the processor system, and one or more algorithms stored in the memory system and executable by the processor system to control parameters of operation of the one or more blower systems.

22. The system of claim 20 comprising a plurality of the blower systems positioned at spaced locations.

23. A method of removing snow from a surface, comprising:

placing a system for snow removal on or adjacent the surface from which snow is to be removed, the system comprising one or more blower systems, each blower system comprising a blower comprising a blower fan to pressurize air, a conduit in fluid connection with the blower, the conduit comprising one or more passages at an axial end thereof distal from the blower from which pressurized air is blown to remove snow from the surface adjacent a position of the one or more blower systems, each of the one or more blower systems further comprising a power system configured to be connected to line power and drawings 20 amps or less, and a base which is fixed at the position, which is on or adjacent of the surface, a support operably connected to the base and extending from the base to connect to the blower, each of the one or more blower system generating noise at a level of 90 db or less during operation, and a control system to control parameters of operation of the blower system, wherein the control system is configured to at least one of activate the blower automatically and to activate the blower upon receiving a manually initiated activation signal, and automatically pivot the conduit reciprocally about a sweep axis over a determined sweep angle of at least 100 degrees via the control system upon activation of the blower until deactivation by the control system, wherein the sweep axis is generally perpendicular to an axis of the conduit.

24. The method of claim 23 wherein the control system comprises a processor system, a memory system in communicative connection with the processor system, and one or more algorithms stored in the memory system and executable by the processor system to control parameters of operation of the one or more blower systems.

25. The method of claim 23 comprising placing a plurality of the blower systems at spaced locations on or in the vicinity of the surface.

* * * * *